United States Patent [19]

Tanaka

[11] Patent Number: 4,819,259

[45] Date of Patent: Apr. 4, 1989

[54] ROTARY ANODE TYPE X-RAY APPARATUS

[75] Inventor: Shigeru Tanaka, Ootawara, Japan

[73] Assignee: Kabushiki Kaisha Toshiba, Kawasaki, Japan

[21] Appl. No.: 909,130

[22] Filed: Sep. 19, 1986

[30] Foreign Application Priority Data

Sep. 20, 1985 [JP] Japan ..... 60-206373

[51] Int. Cl.[4] ..... H01J 35/10; H01J 35/26

[52] U.S. Cl. ..... 378/125; 378/121; 318/806; 318/807

[58] Field of Search ..... 378/119, 125, 127, 131, 378/93–94, 118, 121; 318/798, 806, 807

[56] References Cited

U.S. PATENT DOCUMENTS

| | | | |
|---|---|---|---|
| 2,185,826 | 1/1940 | Atlee | 378/125 |
| 3,456,175 | 7/1969 | Bavor | 378/125 |
| 4,426,720 | 1/1984 | Friedal | 378/93 |
| 4,458,193 | 7/1984 | Jönsson | 318/807 |
| 4,585,985 | 4/1986 | Bose | 318/807 |
| 4,672,288 | 6/1987 | Abbondanti | 318/806 |

*Primary Examiner*—Stanley D. Miller
*Assistant Examiner*—John C. Freeman
*Attorney, Agent, or Firm*—Finnegan, Henderson, Farabow, Garrett, & Dunner

[57] ABSTRACT

A rotary anode type X-ray apparatus includes an arithmetic unit for calculating the optimum number of revolutions of the anode, on the basis of the previously measured and stored temperature-characteristic data of the X-ray tube, at least one of the tube voltages applied to the X-ray tube, the X-ray radiation time, and the tube current. According to frequency of revolution data derived from the arithmetic unit, the motor controller drives the motor to rotate the rotary anode at an appropriate number of revolutions. This number is determined by the X-ray tube drive conditions, including the tube current.

5 Claims, 1 Drawing Sheet

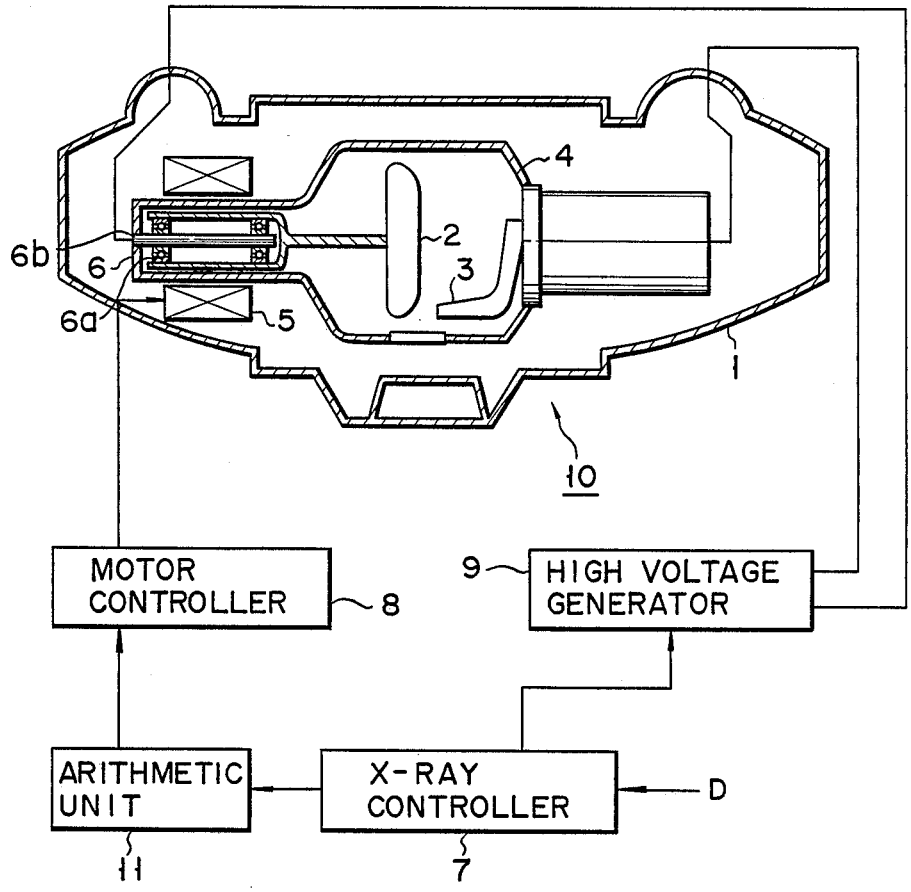
4
2
3
6b
6
6a
5
1
10
MOTOR CONTROLLER
8
9
HIGH VOLTAGE GENERATOR
ARITHMETIC UNIT
11
X-RAY CONTROLLER
7
D

ROTARY ANODE TYPE X-RAY APPARATUS

BACKGROUND OF THE INVENTION

This invention relates to an X-ray apparatus equipped with a rotary anode type X-ray tube. In a conventional X-ray apparatus, a rotary anode type X-ray tube, the anode of which revolves so that the electrons will not strike the anode at one point only, is used to control the temperature rise of the anode. The life of this rotary type X-ray tube is determined by the temperature rise of the inside of the tube, the temperature rise of the anode, and the life of the bearing which holds the anode, allowing it to revolve.

The temperature of the anode rises as the tube current increases, and this results in an increase in the number of electrons emitted from the cathode. The temperature of the anode can be lowered by increasing its rotation speed and substantially expanding the area where the electrons strike, i.e., the target area. If the tube current is small, the temperature rise of the anode is correspondingly small. In such a case, the rotary anode is rotated at a low speed, allowing for the life of the bearing for the motor. Thus, by adjusting the rotating speed of the rotary anode according to the tube current, the life of the X-ray tube can be extended.

To change the rotating speed of the anode, the motor speed is changed. For example, if the tube current is greater than a predetermined value, the motor speed is set to high speed, e.g. 180 rps (revolution per second). When it is below that value, the motor speed is set to low speed, e.g. 60 rps.

In the past, the temperature rise of the anode has been controlled, as described above, by changing the revolution speed of the anode in accordance with the tube current. However, the cause of temperature rise of the anode is not confined solely to the tube current. The temperature also varies according to the tube voltage, radiation time, and size of the focal point. Having not taken these other factors into consideration, the revolution speed has therefore simply been increased when the tube current was large, so that the life of the bearing has consequently been short.

SUMMARY OF THE INVENTION

Accordingly, an object of this invention is to provide a rotary anode type X-ray apparatus, which prevents an excessive temperature rise of the anode, and eliminates unnecessary high speed rotation of the motor.

A rotary anode type X-ray apparatus according to this invention comprises an arithmetic unit for calculating an optimum speed for revolving the anode, on the basis of temperature characteristic data of the X-ray tube, which have been measured and stored, at least one of the tube voltages applied to the X-ray tube, the X-ray radiation time, and the tube current. According to the anode speed data obtained by the arithmetic unit, a motor controller drives a motor for rotating the anode.

BRIEF DESCRIPTION OF THE DRAWINGS

The accompanying drawing is a schematic illustration of a rotary anode type X-ray apparatus according to an embodiment of this invention.

DETAILED DESCRIPTION OF THE PREFERRED EMBODIMENTS

As is shown in FIG. 1, X-ray tube 10 is composed of sealed housing 1, and insert tube 4, which has been placed into sealed housing 1. Insert tube 4 may use a center metal tube having a metal member at its center. Insert tube 4 includes a glass valve, inside which a disc-shaped rotary anode 2 is placed, and cathode 3 is placed facing the target surface of anode 2. Rotary anode 2 is coupled to rotary shaft 6 of the motor. Rotary shaft 6 is supported by bearing 6*a* on a fixed shaft 6*b*. Rotary shaft 6 is surrounded with stator coil 5. The space between insert tube 4 and housing 1 is filled with an insulating oil.

Stator coil 5 is connected to motor controller 8, and the anode shaft is electrically connected to high voltage generator 9. Motor controller 8 is connected to arithmetic unit 11, in order to drive the motor at a revolution speed which corresponds to the output of arithmetic unit 11. The anode and cathode terminals of the X-ray tube are connected to high voltage generator 9. The input terminals of high voltage generator 9 and arithmetic unit 11 are connected to the output terminals of X-ray controller 7. X-ray controller 7 receives X-ray radiation information D, including tube current, tube voltage, and radiation time, then inputs the necessary data to arithmetic unit 11 and high voltage generator 9. The target temperature, which depends on the inter-relation of the tube current, tube voltage, and radiation time, is measured by a simulation. Information D is obtained on the basis of the inter-relation among these measured values and their associated values of tube current, tube voltage, and radiation time. Accordingly, each type of information D corresponds to many target temperature values.

The operation of the X-ray apparatus as applied to an X-ray computed tomography (CT) system, will now be explained.

With an X-ray CT system, the X-ray tube scans the inspected object while rotating around it, and a tomograph of the object is obtained To minimize the amount of radiation received by the inspected object, the X-ray CT system uses an X-ray apparatus providing pulsative radiation, not continuous radiation. Considering the pulse width to be W (msec.), and the number of pulses occurring in one scan to be Np (repetitions per scan), the tube voltage and tube current to be V (KV) and I (mA), respectively, and the base temperature of anode plate to be Tb, the frequency of revolution (f) of anode plate 2 may be obtained, using formula (1)

$$T_{max} \geqq T_b + (\beta\sqrt{(N_p \cdot W)} - \gamma N_p \cdot W)V \cdot I \times 10^6 + \delta(V \cdot I/\sqrt{f}) \quad (1)$$

where Tmax is the solubility limit temperature of the target surface, and is determined by the anode plate. $\beta$, $\gamma$, and $\delta$ are constants as determined by the type of the X-ray tube. Tb is determined by the temperature characteristics of the X-ray tube, for example. The number of revolutions (f) can be calculated by means of formula (1), even if the tube voltage V, tube current I, and X-ray radiation time Np×W values change. In other words, when information D relating to tube voltage V, tube current I, and X-ray radiation time Np×W is input to X-ray controller 7, controller 7 inputs the tube voltage V information to high voltage generator 9, and at the same time, inputs the tube voltage V, tube current I, and X-ray radiation time Np×W data, to arithmetic unit 11. Arithmetic unit 11 calculates the frequency of revolution (f) by means of formula (1), based on the input data. This frequency of revolution (f) information is then input to motor controller 8 which inputs a drive current corresponding to the frequency of revolution (f), to stator coil 5. Rotary shaft 6 is rotated at the frequency (f) by means of the excitation of stator coil 5. Correspondingly, rotary anode 2 revolves at the same frequency (f). In other words, the frequency of revolution (f) is determined in accordance with the target temperature, which is determined by information D.

When high voltage generator 9 applies tube voltage V between anode 2 and cathode 3, ad a filament heating voltage to cathode 3 electrons are generated by cathode 3, and these strike the target surface of anode 2, which then generates X-rays.

The above embodiment is shown with an X-ray apparatus that uses intermittent radiation, but if continuous radiation X-ray equipment is used, the frequency of revolution (f) of the continuous X-ray radiation can be calculated by use of formula (1), by replacing the Np×W value with the continuous radiation time T. Even when the X-ray tube characteristics differ, the coefficients of formula (1) can be changed. Furthermore, new factors, such as the quiescent time of X-ray radiation, and pulse quiescent time, can be used. In this case, radiation quiescent time is the time during which X-ray tube 10 and anode 2 are cooled down, and this time is calculated by arithmetic unit 11.

As is shown above, when the frequency of revolution (f) has been ascertained, a drive voltage corresponding to frequency (f) is supplied to stator coil 5, and anode 2 is revolved at the speed corresponding to the frequency of revolution (f). This speed can be switched between high and low speeds, or can be varied continuously. In case the X-ray tube has a resonant frequency, the frequency of the drive voltage is determined in a manner which avoids revolving the motor at this frequency; for example, 70 Hz.

What is claimed is:

1. A rotary type x-ray apparatus comprising:

an x-ray tube having predetermined temperature characteristics and including a rotary anode rotatable at a predetermined frequency of revolution and wherein said rotary anode has a target area;

x-ray tube drive means for supplying voltage and current to said x-ray tube and causing x-rays to radiate from said x-ray tube, said x-ray tube drive means including means for supplying voltage pulses to said target area;

an arithmetic unit which operates to prestore the predetermined temperature characteristics of said x-ray tube, calculate an optimum frequency of revolution (f) of the rotary anode according to the following formula:

$$Tmax \geqq Tb + (\beta\sqrt{Np \cdot W} - \gamma Np \cdot W) \times V \cdot I \times 10^6 + \delta(V \cdot L/\sqrt{f}),$$

wherein Tmax=the solubility limit temperature of the target area;

W=the pulse width (msec.) of said voltage pulses;

Np=the pulse rate of said voltage pulses;

V=the x-ray tube voltage;

I=the x-ray tube current;

Tb=the temperature characteristics of the X-ray tube; and $\beta$, $\gamma$ and $\delta$=constants determined by the temperature characteristics of the X-ray tube, and produce data corresponding to the calculated optimum frequency of revolution; and rotary anode drive means responsive to the data of optimum frequency of revolution output from the arithmetic unit for rotatably driving said rotary anode at said optimum frequency of revolution.

2. A rotary anode type X-ray apparatus according to claim 1, in which said rotary anode drive means includes means for selectively changing the frequency of revolution to one of at least two values, in response to the frequency of revolution data from said arithmetic unit.

3. A rotary anode type X-ray apparatus according to claim 1, in which said rotary anode drive means includes means for continuously changing the frequency of revolution in response to the frequency of revolution data from said arithmetic unit.

4. A rotary anode type X-ray apparatus according to claim 1, wherein said X-ray tube has a resonant frequency, and said rotary anode drive means further includes means for rotatably driving said rotary anode at a frequency different from said resonant frequency at times when the frequency of revolution equals said resonant frequency.

5. A rotary anode type X-ray apparatus according to claim 1, in which said X-ray tube drive means includes means for intermittently driving said X-ray tube, to generate X-rays from said X-ray tube in an intermittent manner.

* * * * *